US006036906A

United States Patent [19]

Tadros et al.

[11] Patent Number: 6,036,906

[45] **Date of Patent: *Mar. 14, 2000**

[54] METHOD FOR MANUFACTURING AN IMPROVED PRESTRESSED CONCRETE JOIST

[75] Inventors: Maher K. Tadros; Amin Einea; Mohsen Saleh, all of Omaha, Nebr.

[73] Assignee: Board of Regents University of Nebraska, Lincoln, Lincoln, Nebr.

[ * ] Notice: This patent is subject to a terminal disclaimer.

[21] Appl. No.: 08/902,550

[22] Filed: Jul. 29, 1997

Related U.S. Application Data

[62] Division of application No. 08/635,996, Apr. 22, 1996, Pat. No. 5,671,573.

[51] Int. Cl.[7] ..... B28B 1/14; B28B 23/04; B28B 23/06

[52] U.S. Cl. ..... 264/228; 264/229; 264/277; 264/278; 264/279; 264/279.1

[58] Field of Search ..... 264/228, 229, 264/277, 278, 279, 279.1

[56] References Cited

U.S. PATENT DOCUMENTS

| | | | |
|---|---|---|---|
| 2,153,741 | 4/1939 | Cobi | 264/228 |
| 3,114,936 | 12/1963 | Willson | 264/228 |
| 3,349,527 | 10/1967 | Bruns . | |
| 3,577,504 | 5/1971 | Lipski . | |
| 3,813,834 | 6/1974 | Davis, Jr. . | |
| 3,919,824 | 11/1975 | Davis, Jr. . | |
| 4,041,664 | 8/1977 | Davis, Jr. . | |
| 4,144,690 | 3/1979 | Avery . | |
| 4,251,047 | 2/1981 | Holtvogt . | |
| 4,259,822 | 4/1981 | McManus . | |
| 4,295,310 | 10/1981 | McManus . | |
| 4,455,269 | 6/1984 | Spamer et al. . | |

(List continued on next page.)

FOREIGN PATENT DOCUMENTS

| | | | |
|---|---|---|---|
| 744518 | 10/1966 | Canada | 52/223.8 |

OTHER PUBLICATIONS

Title: Prestress Strand Restraining Devices, pp. 81 and 84, Pub. Dayton Superior Catalog No Date Available.

Author: John M. Savage, et al., Title: Behavior and Design of Double Tees with Web Openings Date: Jan.–Feb. 1996, pp. 46–62, Pub.: PCI Journal.

*Primary Examiner*—Karen Aftergut

*Attorney, Agent, or Firm*—Suiter & Associates PC

[57] ABSTRACT

A precast, prestressed concrete joist having web openings through which mechanical and electrical equipment may pass. In an exemplary embodiment, the joist comprises generally horizontal opposite top and bottom concrete members with a concrete web interposed between them. This web may have openings through which mechanical and electrical equipment may pass. Prestress steel strands may extend lengthwise through both the top and bottom members to provide prestress in the concrete joist. The concrete joist may further comprise strand restraining devices for deflecting the prestress steel strands. The precast, prestressed concrete joist having a web opening may be constructed using a reusable casting apparatus. This casting apparatus comprises a prestressing bed onto which a frame may be mounted. The frame provides a means of applying tension to the prestress steel strands and of supporting prestress strand restraining devices. A mold comprising an outer form and web opening forms may be attached to the prestressing bed. This mold may be used to cast the joist. The web opening forms preferably comprise a plurality of blocks which may be specially shaped to be removably attached together and secured to the prestressing bed to increase or decrease the span and depth of the desired web openings. The precast, prestressed concrete joist may be fabricated by first assembling the frame on a prestressing bed. The mold may next be assembled inside the frame. Strand restraining devices may be bolted to the frame by threaded rods. Prestress strands may then be threaded through these strand restraining devices and anchored to the frame. A prestressing force may then be applied to the prestress strands. Concrete is then poured into the mold and allowed to cure. The frame and mold are removed from around the finished joist.

19 Claims, 13 Drawing Sheets

U.S. PATENT DOCUMENTS 4,700,519 10/1987 Person et al. .
4,715,155 12/1987 Holtz .
5,072,565 12/1991 Wilnau .
5,074,095 12/1991 Wilnau .
5,113,631 5/1992 DiGirolamo et al. .
5,299,445 4/1994 Yee ..... 264/228
5,305,572 4/1994 Yee ..... 264/228
5,397,096 3/1995 Nelson .
5,671,573 9/1997 Tadros et al. ..... 52/223.8

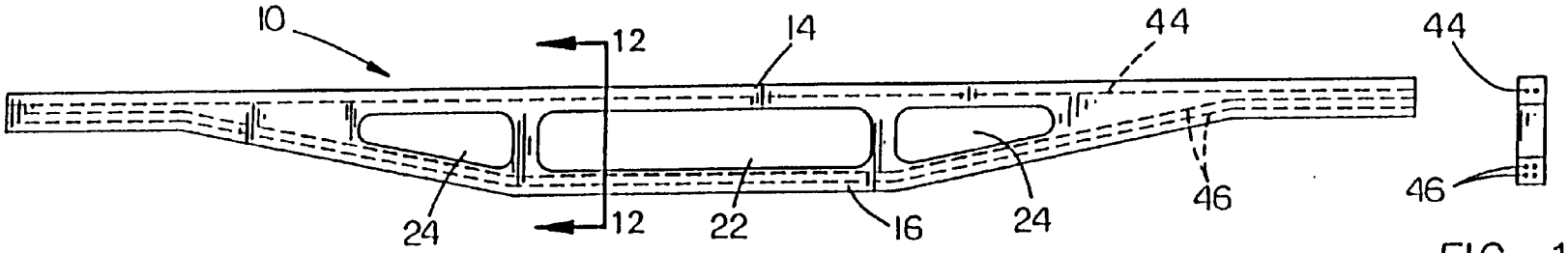
FIG. 11
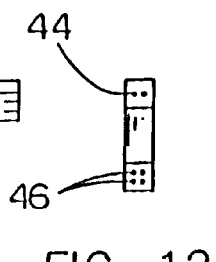
FIG. 12
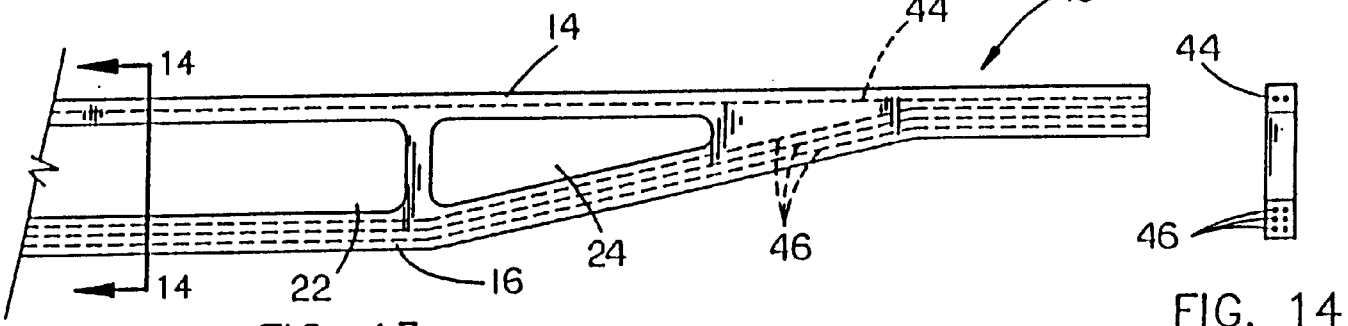
FIG. 13
FIG. 14
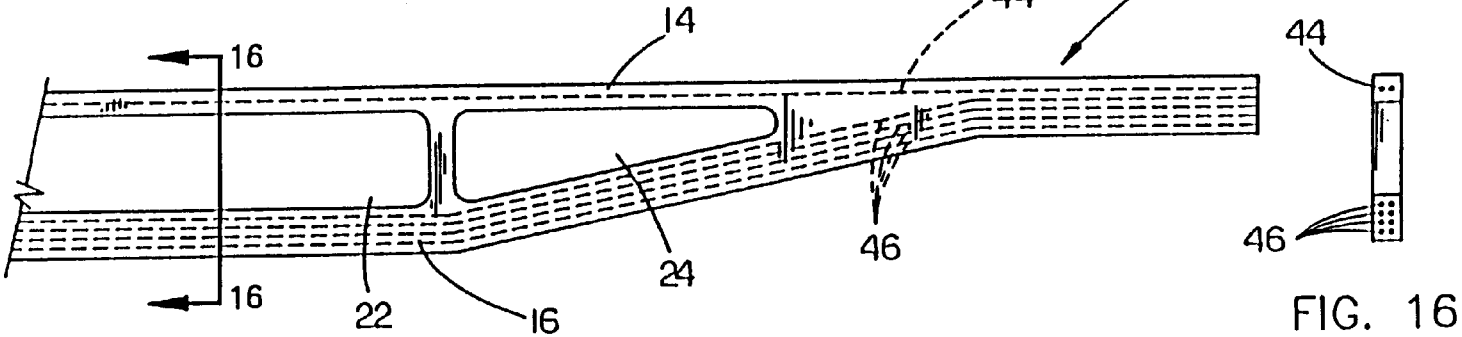
FIG. 15
FIG. 16

METHOD FOR MANUFACTURING AN IMPROVED PRESTRESSED CONCRETE JOIST

The present application is a divisional of U.S. application Ser. No. 08/635,996, filed Apr. 22, 1996, now U.S. Pat. No. 5,671,573.

TECHNICAL FIELD

The present invention relates generally to the manufacture and use of precast concrete joists and specifically to methods and apparatus for manufacturing and using a pre-cast, prestressed concrete joist having integral web openings.

BACKGROUND OF THE INVENTION

Precast concrete double tee joists are one of the most popular precast concrete floor framing systems. However, compared to open steel joists, standard concrete joists are heavy and do not allow mechanical and electrical equipment (i.e. HVAC systems, electrical wiring, plumbing and the like) to pass through them. Placing web openings in these joists to allow equipment to pass through them is a significant improvement, reducing the floor to floor height and overall building height. This reduced building height can result in significant economy in the cost of the building and in the mechanical and electrical systems installed therein. A further benefit of using joists with web openings is weight reduction. This weight reduction also results in reduced vertical gravity loads and horizontal seismic forces in the supporting beams, columns, and foundation.

Other researchers have experimented with precast, prestressed concrete beams having integral web openings. However, previous researchers have typically proposed rather involved procedures to design for the web opening, making the construction and use of these concrete joists difficult and costly. Consequently, the prior art has failed to develop a precast, prestressed concrete joist having web openings which may be efficiently manufactured to meet a wide variety of spans, spacing, and loading requirements.

OBJECTS OF THE INVENTION

Therefore, it is an object of the present invention to develop a precast, prestressed concrete joist or beam having integral web openings which is easy to construct while remaining useable in a wide variety of building applications.

It is another object of the present invention to provide a precast, prestressed concrete joist or beam having web openings through which mechanical and electrical equipment may pass.

It is yet another object of the present invention to provide a precast, prestressed concrete joist or beam having integral web openings which may be efficiently manufactured to meet a variety of span and loading requirements.

It is a further object of the present invention to provide apparatus and methods to efficiently manufacture a precast, prestressed concrete joist or beam having integral web openings.

It is yet a further object of the present invention to provide a precast, prestressed concrete joist or beam which does not exhibit the vibration found in floors supported by metal joists.

It is yet still a further object of the present invention to provide a precast, prestressed concrete joist or beam which is less prone to corrosion than metal joists.

It is yet still another further object of the present invention to provide a precast, prestressed concrete joist or beam which has a higher fire rating than metal joists.

SUMMARY OF THE INVENTION

The present invention provides a precast, prestressed concrete joist having integral web openings through which mechanical and electrical equipment may pass. In an exemplary embodiment, the joist comprises generally horizontal opposite top (compression) and bottom (tension) concrete members which are adjoined to form two opposing and generally horizontal prismatic segments. A concrete web, which may have openings through which mechanical and electrical equipment may pass, may be interposed between the top and bottom members. The top and bottom members and web may be of uniform width. Preferably, the top member and the prismatic segments have a flat upper face to support concrete slab flooring. A plurality of U-shaped ties may be cast into the top member and the prismatic segments to secure in situ cast concrete flooring. Further, a plurality of shear keys may be cast into the upper face of the top member and the prismatic segments. The bottom member may generally be prismatic consisting of, opposing left and right angled surfaces extending downward between the prismatic segments and a central horizontal surface positioned between the opposing left and right angled surfaces. Preferably, steel prestress strands or the like may extend lengthwise through both the top and bottom members and prismatic segments and outer left and right horizontal surfaces to provide prestress in the concrete joist. The concrete joist may further comprise strand restraining devices for deflecting the prestress strands extending lengthwise through the top and bottom members and prismatic segments. Additionally, steel reinforcement bars may extend vertically from the top member through the web and into the bottom member to provide added strength.

The precast, prestressed concrete joist having a web opening may be constructed utilizing a reusable casting apparatus. This casting apparatus may comprise a prestressing bed having a horizontal flat surface onto which a prestressing frame may be mounted. This frame may consist of an outer frame extending around the perimeter of the prestressing bed and a plurality of generally U-shaped draping frames which may be removably attached to the outer frame so that they extend over the prestressing bed. The prestressing frame provides a means for applying tension to prestress strands and of supporting the prestress strand restraining devices. Preferably, the strand restraining devices are held in place by threaded rods removably attachable to the draping frames. A mold comprising an outer form and web opening forms may be attached to the prestressing bed. This mold may be used to cast the joist. Preferably, the outer form has a shape and depth corresponding to the shape and width of the concrete joist. The web opening forms preferably comprise a plurality of permanent and customizable blocks or sections having the width of the desired joist. These blocks are specially shaped such that they may be removably attached together and secured to the prestressing bed to increase or decrease the span and depth of the web openings and thus the joist. A means of pouring concrete into the mold may also be provided.

In an exemplary embodiment, the precast, prestressed concrete joist may be fabricated by first assembling the frame on the prestressing bed. The mold may next be assembled inside the frame on the prestressing bed. Strand restraining devices may be bolted to the draping frames by threaded rods. Prestress strands may then be threaded through these strand restraining devices and anchored to one end of the prestressing frame so that a prestressing force may be applied to them. A plurality of corrugated form may be attached to the flat surface of the outer form in order to cast shear keys. Concrete may then be poured into the mold and allowed to cure. After the concrete has hardened, the frame and mold may be removed from around the finished joist.

These and other features, aspects, and advantages of the present invention will become better understood with regard to the following description, appended claims, and accompanying drawings.

BRIEF DESCRIPTION OF THE DRAWINGS

FIG. 11 is a side elevational view of a precast, prestressed concrete joist according to an exemplary embodiment of the present invention having two prestress strands above the web openings and four prestress strands below the web openings;

FIG. 12 is a cross-sectional end view of the joist shown in FIG. 11;

FIG. 13 is an elevational view of a precast, prestressed concrete joist according to an exemplary embodiment of the present invention having two prestress strands above the web openings and six prestress strands below the web openings;

FIG. 14 is a cross-sectional end view of the joist shown in FIG. 13;

FIG. 15 is an elevational view of a precast, prestressed concrete joist according to an exemplary embodiment of the present invention having two prestress strands above the web openings and eight prestress strands below the web openings;

FIG. 16 is a cross-sectional end view of the joist shown in FIG. 15;

DETAILED DESCRIPTION OF THE INVENTION

Figure 1:
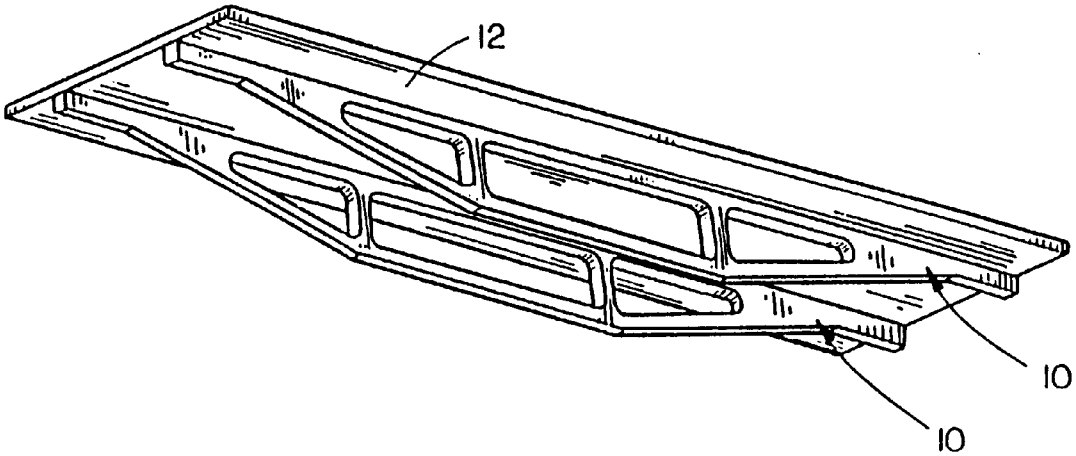
FIG. 1 is a pictorial view depicting two precast, prestressed concrete joists according to an exemplary embodiment of the present invention supporting a concrete floor panel.

FIG. 1 is a pictorial view depicting two precast, prestressed concrete joists 10 according to an exemplary embodiment of the present invention supporting a concrete floor panel 12. The floor panel 12 may be a precast concrete slab that is placed at the building site, an in situ or cast-in-place concrete slab, or the like.

Figure 2:
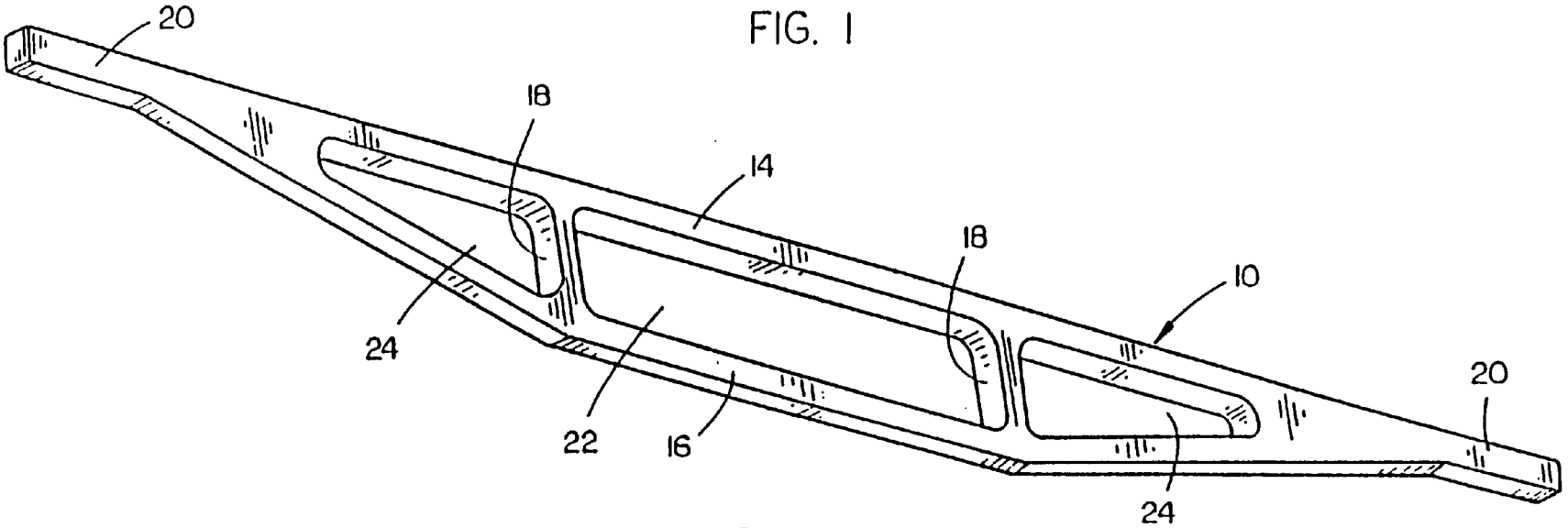
FIG. 2 is a pictorial view illustrating one of the precast, prestressed concrete joists shown in FIG. 1.

FIG. 2 is a pictorial view illustrating the precast, prestressed concrete joist 10 shown in FIG. 1. The joist comprises top 14 and bottom 16 members, separated by a web 18 and terminated in prismatic segments 20. In an exemplary embodiment, the joist has three web openings: a rectangular opening 22, and two triangular openings 24. The corners of these openings may be chamfered or rounded to relieve stress. Preferably, joists may be constructed in three different depths: 24, 32, and 36 inches (61.0, 81.0, and 91.5 cm). These depths accommodate a full range of spans, varying from 24 feet to 140 feet (7.3 to 42.7 m). In a preferred embodiment, a joist having a depth of 24 inches (61.0 cm) may accommodate a range of spans from 24 feet to 100 feet (7.3 to 30.5 m), a joist having a depth of 32 inches (81.0 cm) may accommodate a range of spans from 29 feet to 130 feet (8.8 to 40.0 m), and a joist having a depth of 36 inches may accommodate a range of spans from 32 feet to 140 feet (9.7 to 42.7 m).

The joist may be made of High Performance Concrete (HPC) mix. HPC is a concrete that meets special performance and uniformity requirements such as ease of placement and consolidation without affecting strength, superior long-term mechanical properties, early high strength, volume stability, and long life in severe environments. In an exemplary embodiment, High Performance Concrete may have a strength of 12,000 psi at 28 days, and may comprise the following components combined in the following proportions:

| | |
|---|---|
| Cement (Type I) | 750 lbs. |
| Fly Ash (Class C) | 200 lbs. |
| Silica Fume (Master Builders) | 50 lbs. |
| Water | 240 lbs. |
| Sand (ASTM C-33) | 990 lbs. |
| ½" Limestone | 1860 lbs. |
| Air Content (Entrapped) | 2.0% |
| Water Reducer (WRDA-82) | 4 oz./100 lbs. |
| High Range Water Reducer (WRDA-19) | 30 oz./100 lbs |

Figure 3:
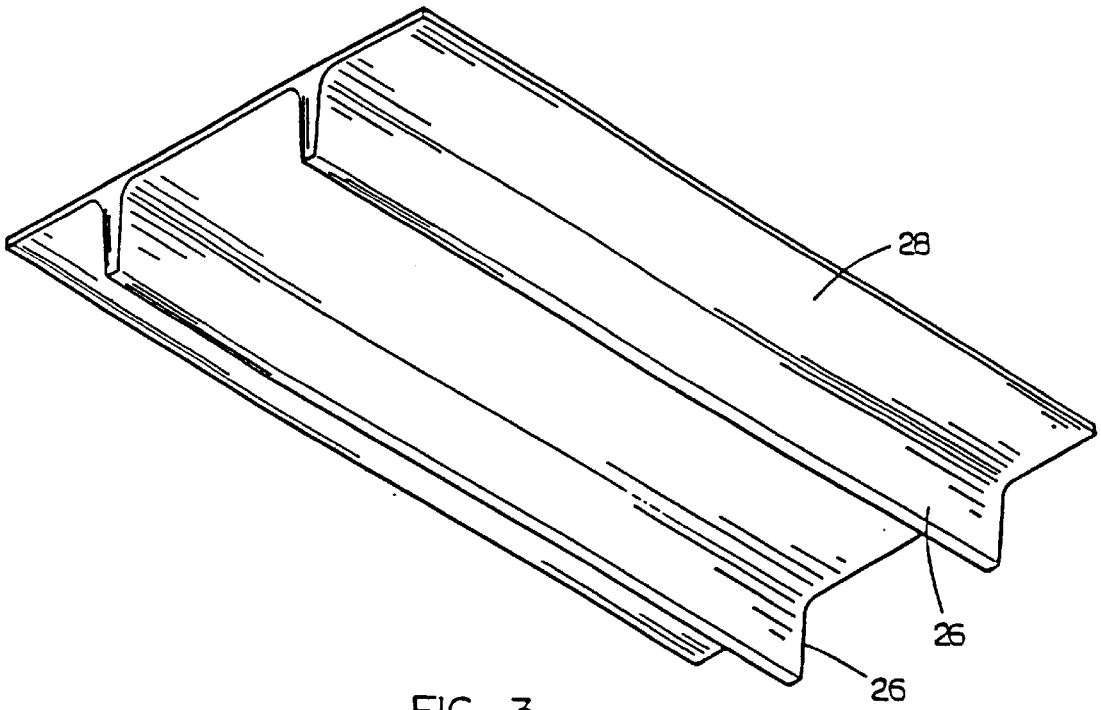
FIG. 3 (PRIOR ART)
FIG. 3 is a pictorial view illustrating precast, prestressed concrete joists according to prior art supporting a concrete floor panel.
Figure 4:
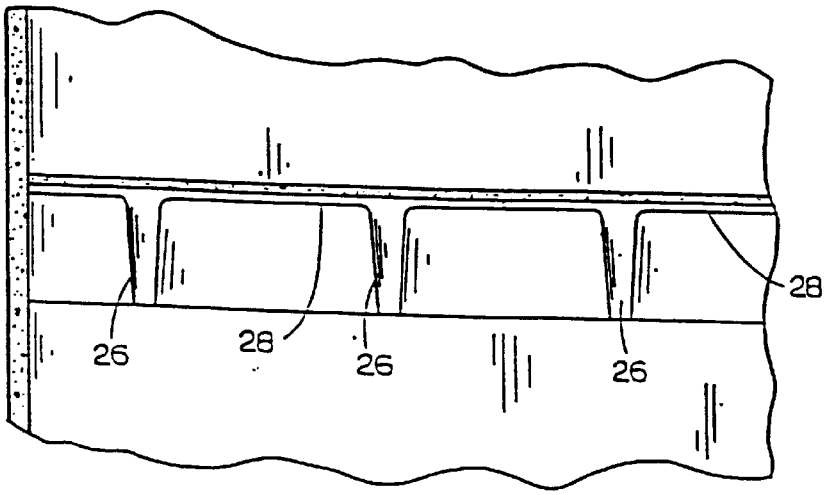
FIG. 4 (PRIOR ART)
FIG. 4 is a cross-sectional side elevational view of the joists (prior art) shown in FIG. 3 used in the construction of a building.
Figure 5A:
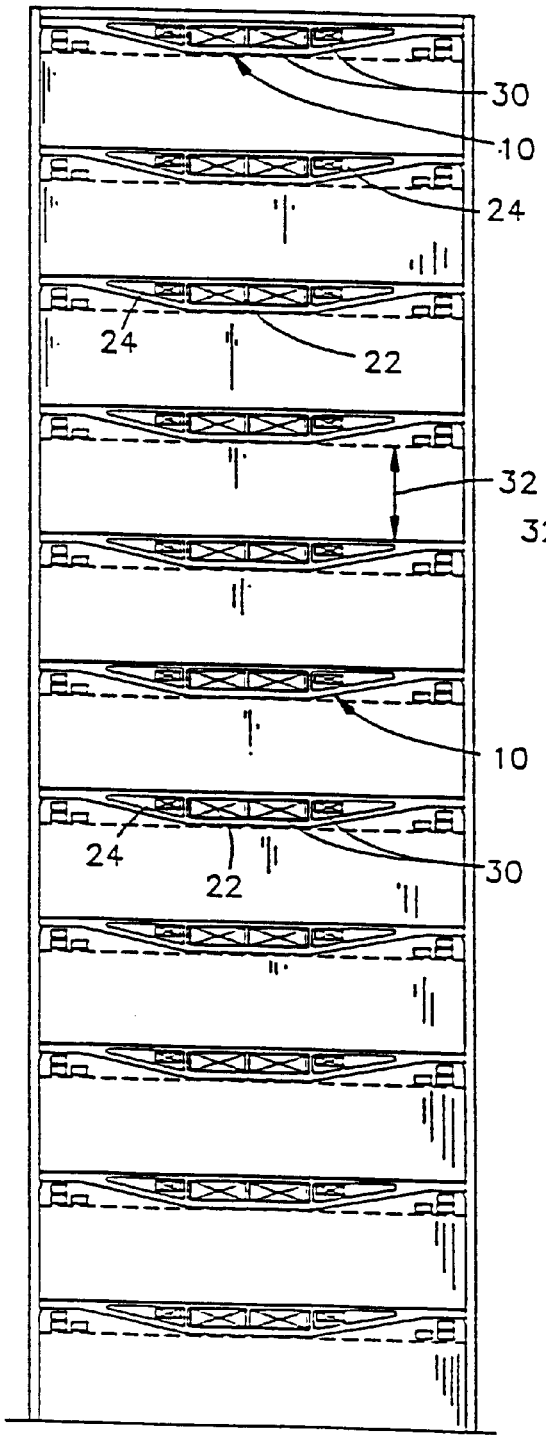
FIGS. 5A and 5B are elevational views depicting a building using joists constructed according to an exemplary embodiment of the present invention (FIG. 5A) and a building constructed using joists of the prior art (FIG. 5B)
Figure 5B:
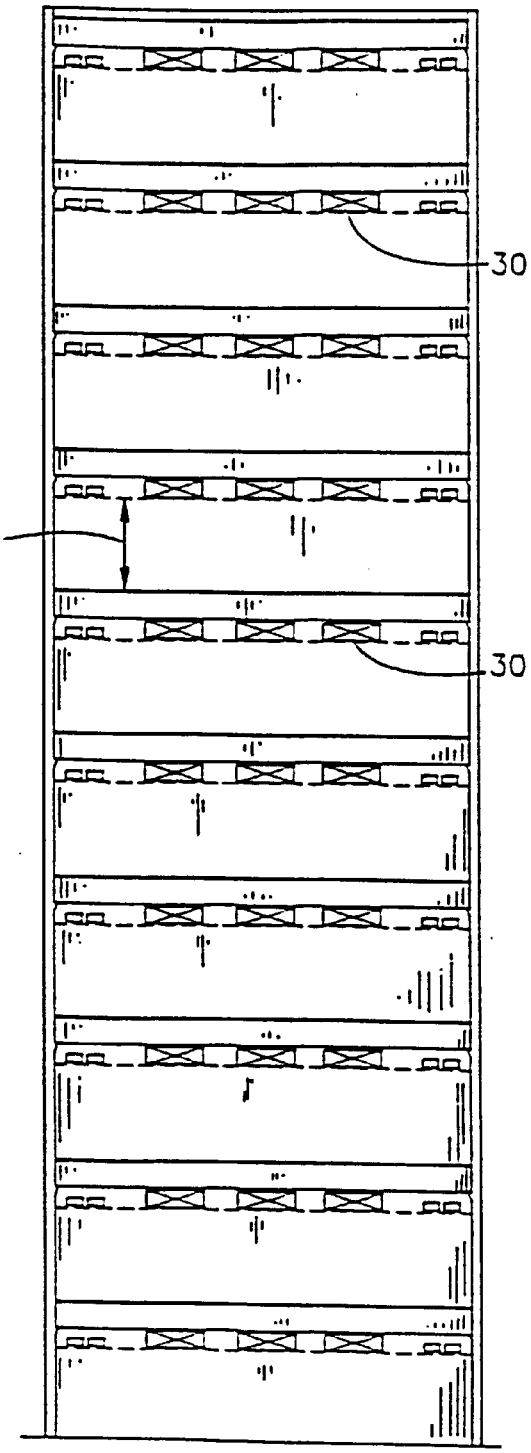
FIG. 5B (PRIOR ART)

FIGS. 3 and 4 illustrate prior art. FIG. 3 is a pictorial view illustrating precast, prestressed concrete joists 26 according to prior art supporting a concrete floor panel 28. The prior art joists do not have web openings. Thus mechanical and electrical equipment must be passed under them. FIG. 4 is a cross-sectional side elevational view of the joists and floor panel (prior art) shown in FIG. 3 used in the construction of a building;

FIGS. 5A and 5B are elevational views depicting a building using joists constructed according to an exemplary embodiment of the present invention (FIG. 5A) and a building constructed using joists of the prior art (FIG. 5B). The joists 10 shown in FIG. 5A comprise web openings (22 & 24). Mechanical and electrical equipment 30 such as HVAC systems, plumbing, electrical wiring, telecommunications wiring and the like may be passed through these openings thereby reducing floor-to-floor height and overall cost of the building. In contrast, the building in FIG. 5B is constructed using conventional joists (prior art). All mechanical and electrical equipment 30 must be routed under these joists. The result is a greater floor-to-floor height. For example, the buildings of FIGS. 5A and 5B have identical floor-to-ceiling heights 32 and approximately the same overall height. However, the building shown in FIG. 5A (utilizing the present invention) has 11 stories, while the building shown in FIG. 5B (prior art) has only 10 stories. Consequently, less building materials are required to construct this building resulting in reduction in the overall cost of the building.

Figure 6:
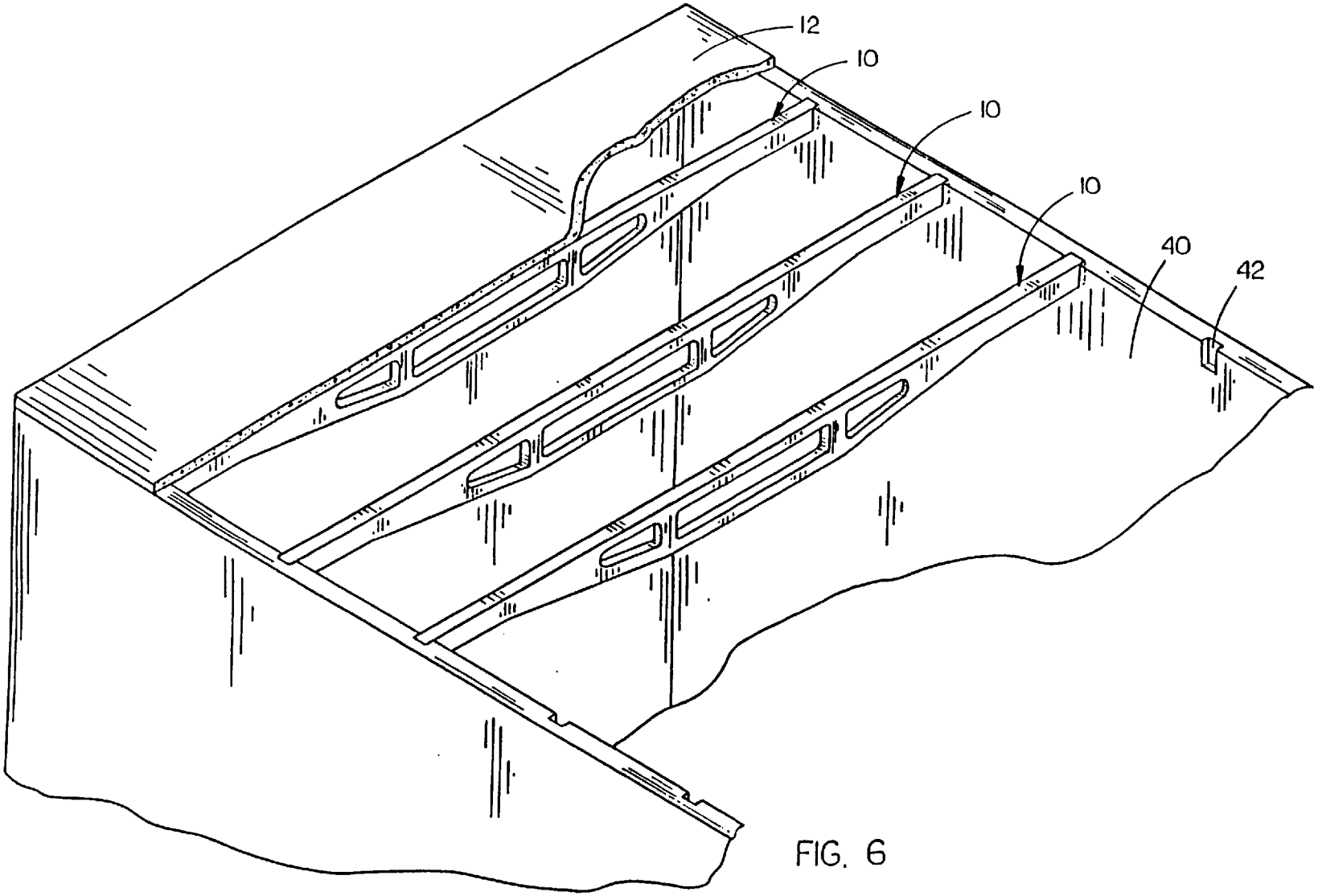
FIG. 6 is a partial cross-sectional pictorial view of joists according to an exemplary embodiment of the present invention supporting a concrete floor.

FIG. 6 is a partial cross-sectional pictorial view of joists 10 according to an exemplary embodiment of the present invention supporting a concrete floor 12. Walls 40, which may be precast, cast-in-place, or the like may have indentions or notches 42 to mate with joists 10 to support a floor, ceiling, roof or the like.

Figure 7:
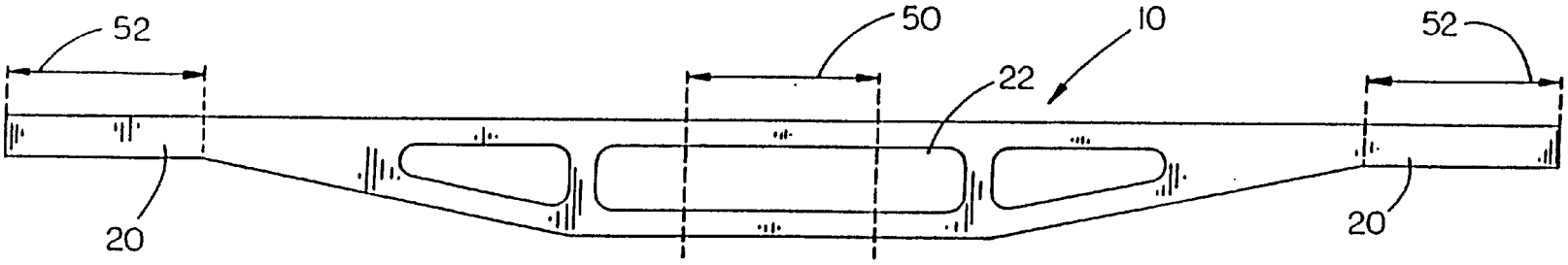
FIG. 7 is a side elevational view of the invention illustrating how the span of the joist may be varied to meet different requirements.

FIG. 7 is a side elevational view of the invention illustrating how the span of the joist may be varied to meet different requirements. Large increments of length (i.e. increments of 5 ft.) span changes may be made by increasing or decreasing the length 50 of the interior opening 22. Small increments of length (i.e. fractions of 5 ft.) span changes may be made by increasing or decreasing the length 52 of the prismatic segment 20.

Figure 8:
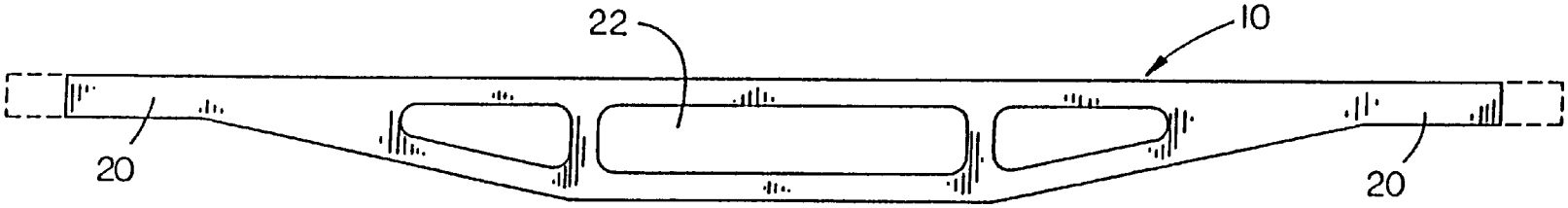
FIG. 8 is a side elevational view of the present invention illustrating how the span of the joist may be varied to meet different requirements.

FIG. 8 is a side elevational view of the present invention illustrating how the span of the joist may be varied to meet different requirements. The length of this joist has been reduced compared with the length of the joist shown in FIG. 7 by reducing the length 52 of the prismatic segments 20.

Figure 9:
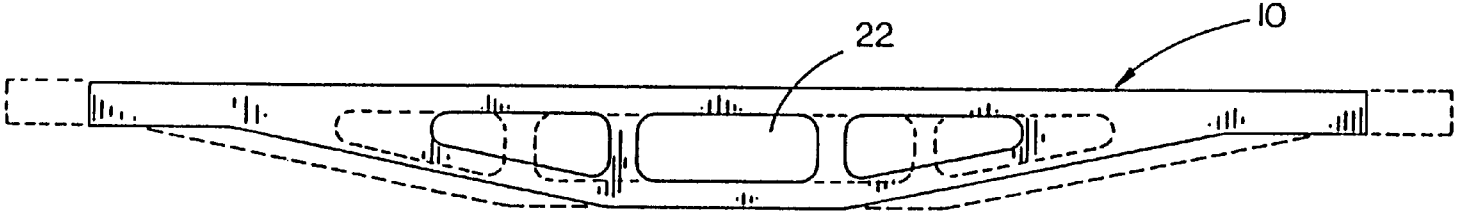
FIG. 9 is a side elevational view of the present invention illustrating how the depth of the joist may be held constant while the span of the joist is increased or decreased.

FIG. 9 is a side elevational view of the present invention illustrating how the proportions of the joist are held constant while the span of the joist is increased or decreased. The length of this joist has been reduced as compared to the length of the joist shown in FIG. 7. This has been accomplished by reducing the length of the of the interior opening 22.

Figure 10:
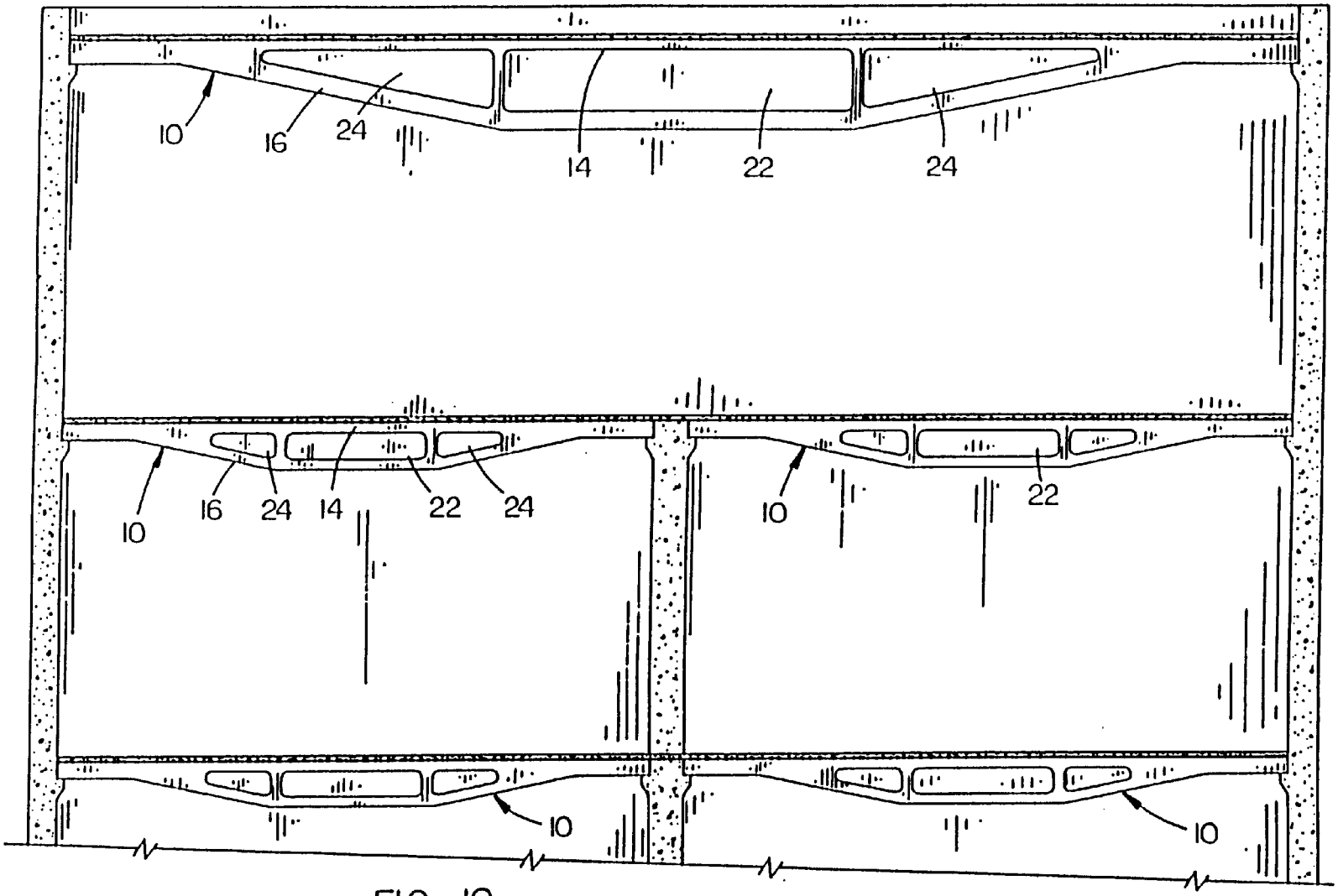
FIG. 10 is a cross-sectional elevational view of a building illustrating the use of joists according to an exemplary embodiment of the present invention having different spans and depths.

FIG. 10 is a cross-sectional elevational view of a building illustrating the use of joists having different spans and depths. Changes in depth of the joist may be obtained by varying the thickness of the top 14 and bottom 16 members and the depth of the web openings (22 & 24).

FIGS. 11 through 16 illustrate the use of various numbers of prestress strands in construction of precast, prestressed concrete joists according to exemplary embodiments of the present invention. Preferably, ASTM standard 7-wire steel prestress strands may be used. As the depth and span of the joist is increased, the number of prestress strands used must be increased to maintain the proper level of prestress in the joist.

FIG. 11 is a side elevational view of a precast, prestressed concrete joist 10 of a preferred embodiment of the present invention having a depth of 24 inches. This joist 10 may have two prestress strands 44 extending through the top member 14 above the web openings (22 & 24) and four prestress strands 46 extending through the bottom member 16 below the web openings (22 & 24). FIG. 12 is a cross-sectional end view of the joist 10 shown in FIG. 11 depicting the placement of the prestress strands (44 & 46).

FIG. 13 is a partial side elevational view of a precast, prestressed concrete joist 10 of a preferred embodiment of the present invention having a depth of 30 inches. This joist 10 may have two prestress strands 44 extending through the top member 14 above the web openings (22 & 24) and six prestress strands 46 extending through the bottom member 16 below the web openings (22 & 24). FIG. 14 is a cross-sectional end view of the joist 10 shown in FIG. 13 depicting the placement of the prestress strands (44 & 46).

FIG. 15 is a partial side elevational view of a precast, prestressed concrete joist 10 of a preferred embodiment of the present invention having a depth of 36 inches. This joist 10 may have two prestress strands 44 extending through the top member 14 above the web openings (22 & 24) and eight prestress strands 46 extending through the bottom member 16 below the web openings (22 & 24). FIG. 16 is a cross-sectional end view of the joist shown in FIG. 15 depicting the placement of the prestress strands (44 & 46).

Figure 17:
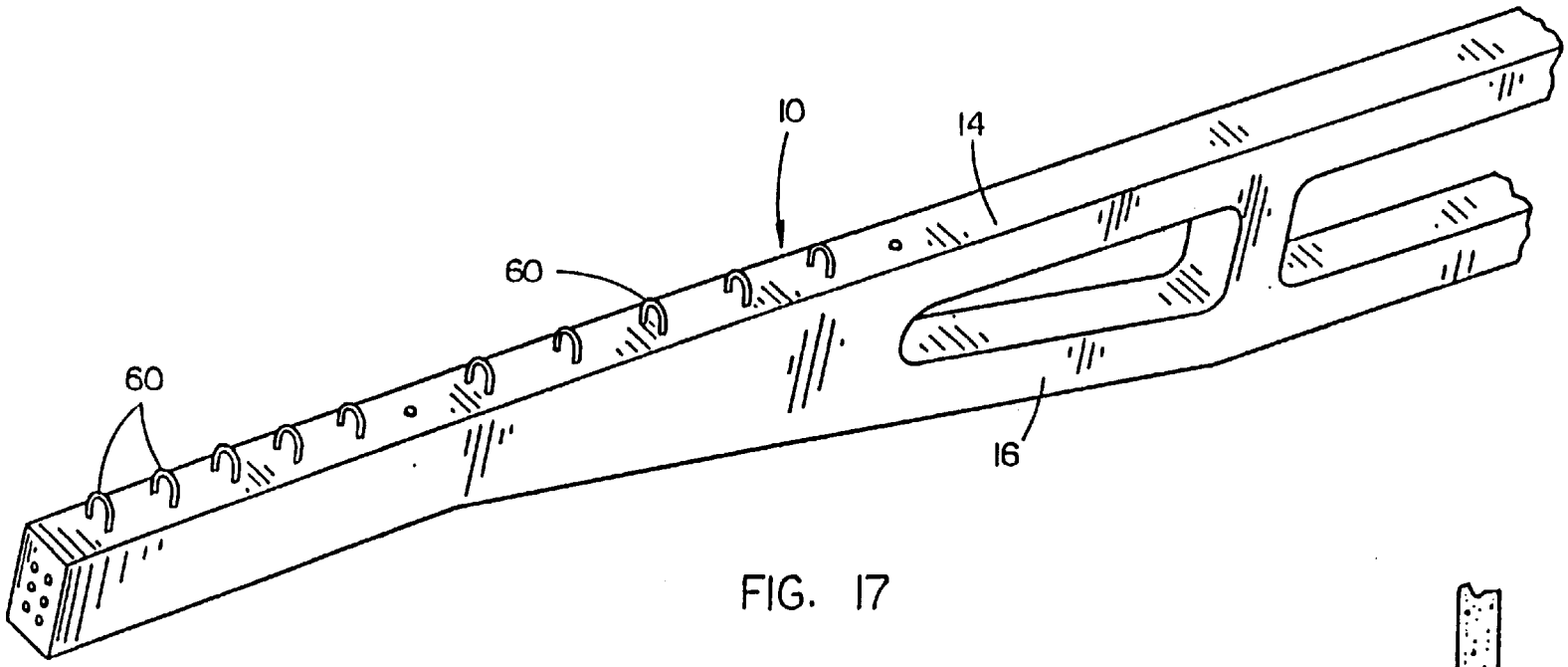
FIG. 17 is a partial pictorial view of a joist according to and exemplary embodiment of the present invention having U-shaped steel ties for attaching an in situ cast concrete floor panel.

FIG. 17 is a partial pictorial view of a joist 10 according to an exemplary embodiment, the present invention having U-shaped steel ties or stirrups for attaching an in situ cast concrete floor or roof panel. The ties 60 may be embedded in the concrete joist when it is cast. Rebars (not shown) may be fastened to the ties so that the floor or roof panel (see FIG. 18) may be cast in place.

Figure 18:
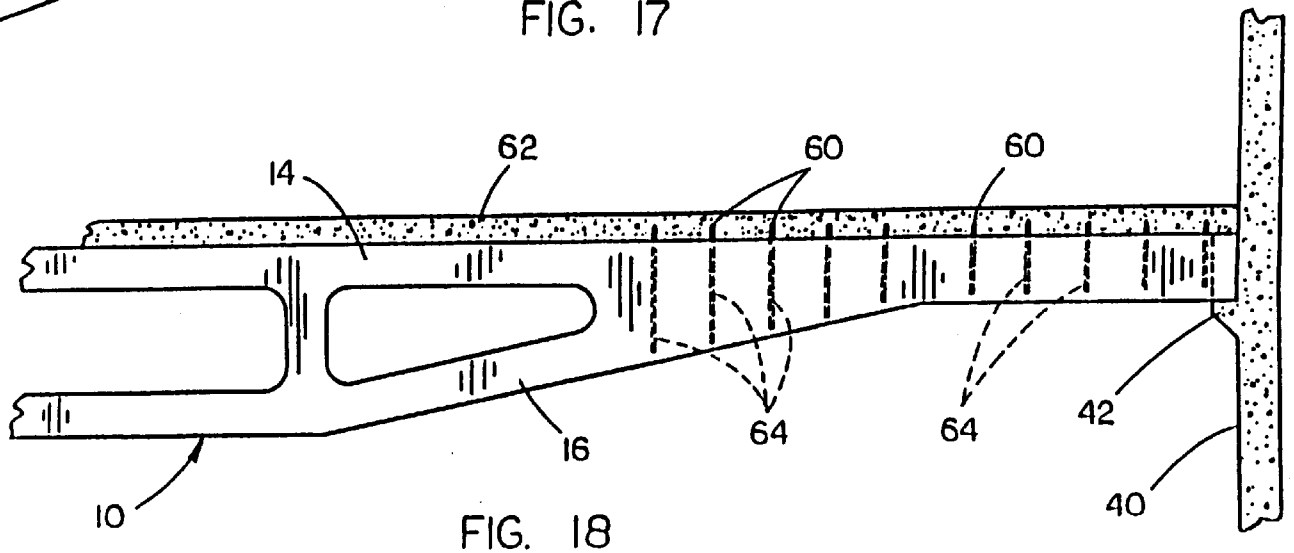
FIG. 18 is a partial cross-sectional side elevational view of the joist shown in FIG. 17 supporting an in situ cast concrete floor panel.

FIG. 18 is a partial cross-sectional side elevational view of the joist 10 shown in FIG. 17 supporting an in situ cast concrete floor or roof panel 62. The legs 64 of the ties 60 may extend through the top member 14 and web into the bottom member 16. The precast, prestressed concrete joist may be supported by notch 42 in wall 40 which may also be precast or may be cast in place.

Figure 19:
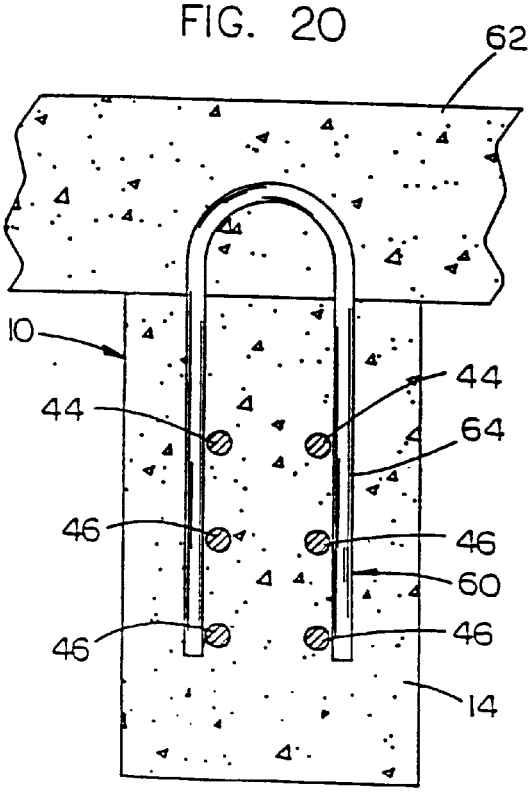
FIG. 19 is a partial cross-sectional end elevational view of the joist shown in FIG. 17 illustrating detail of the U-shaped ties which may be used to support an in situ cast concrete floor panel.

FIG. 19 is a partial cross-sectional end elevational view of the joist shown in FIG. 17 illustrating detail of the U-shaped ties 60 which may be used to secure an in situ cast concrete floor panel 62. Preferably, the legs 64 of the ties 60 extend into the top member 14 of the joist 10 and on either side of the prestress strands 44.

Figure 20:
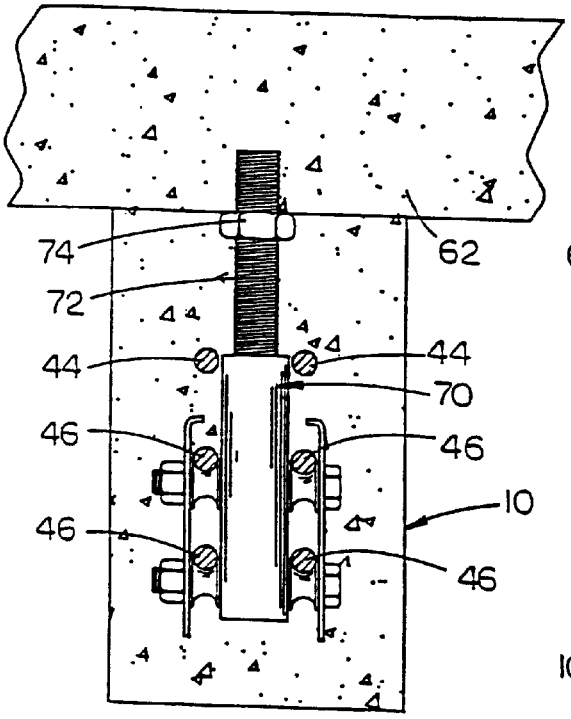
FIG. 20 is a partial cross-sectional end elevational view of an exemplary embodiment of the present invention illustrating a utilization of prestress strand restraining devices.
Figure 21:
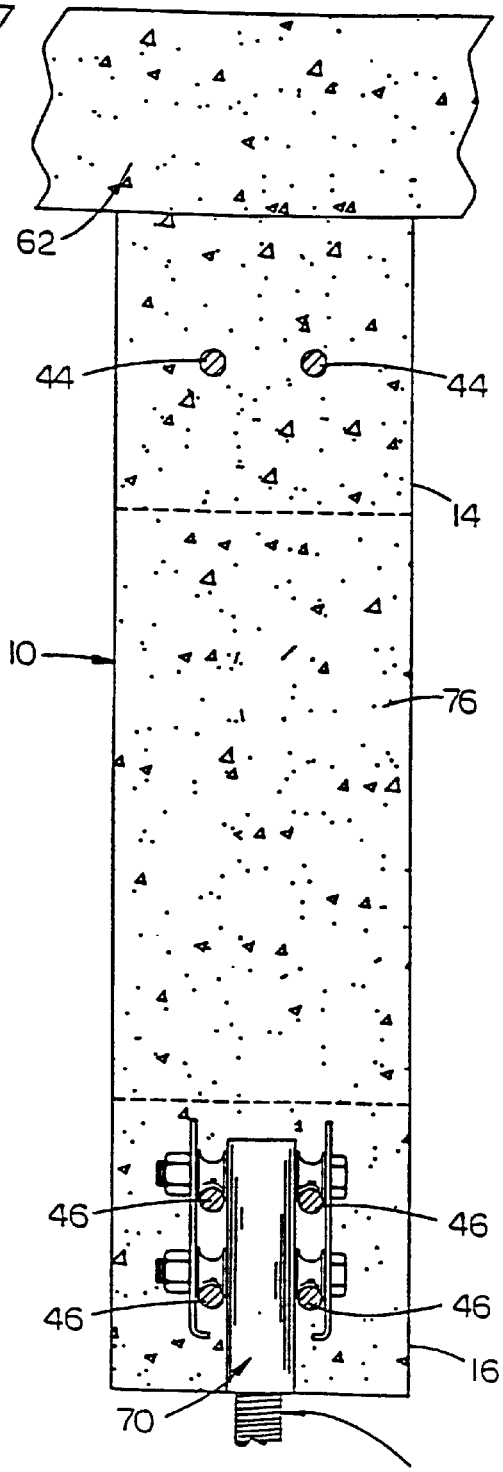
FIG. 21 is a partial cross-sectional end elevational view of an exemplary embodiment of the present invention illustrating a utilization of prestress strand restraining devices.

FIGS. 20 and 21 are partial cross-sectional end elevational views of the joist 10 according to a preferred embodiment of the present invention illustrating the utilization of prestress strand restraining devices 70. FIG. 20 illustrates a prestress strand restraining devise located at the point where the prismatic segment transitions into the bottom member. FIG. 21 illustrates a prestress strand restraining devise located at a point where the top member 14 and bottom member are fully separated by a web 76. The prestress strand restraining devices 70 provide more favorable distribution of stresses within the joist 10 by deflecting the prestress strands 46. Preferably, strands 44 extending through the top member need not be deflected. The prestress strand restraining devices 70 may be held in place during casting by a threaded rod 72 which is held against the casting apparatus frame (not shown) by a nut 74. After the concrete joist hardens, the threaded rod may be cut off above the nut 74 or otherwise released from the frame. If an in situ concrete floor 62 is applied over the joist, the threaded rod may extend into the floor to provide additional attachment.

Figure 22:
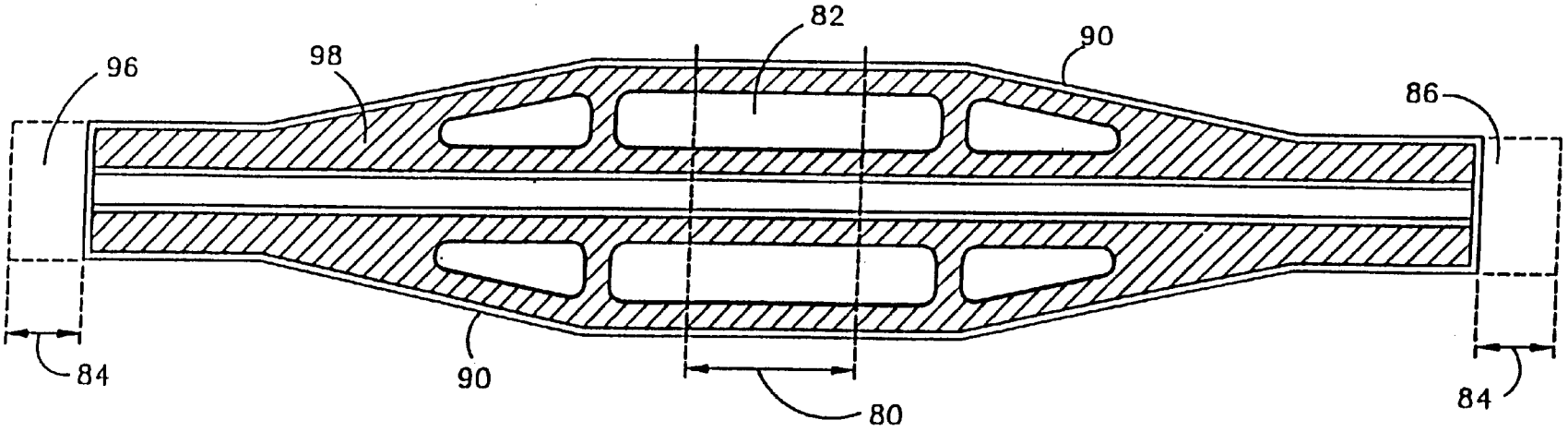
FIG. 22 is a plan view of the form utilized to cast the concrete joists of the present invention illustrating how the form may be lengthened and shortened to form joists of fixed depth and various spans.

FIG. 22 is a plan view of an exemplary embodiment of the form 90 utilized to cast the concrete joists. The form 90 may be assembled on a prestressing bed 88. FIG. 22 illustrates how the form may be lengthened and shortened to form joists of various spans. Large increments of length (i.e. increments of 5 ft.) span changes 86 & 96 may be made by increasing or decreasing the length 80 of the form 90 in the area of the interior opening 82. Small increments of length (i.e. fractions of 5 ft.) span changes 86 & 96 may be made by increasing or decreasing the length 84 of the form 90 in the area of the prismatic segment 98.

Figure 23:
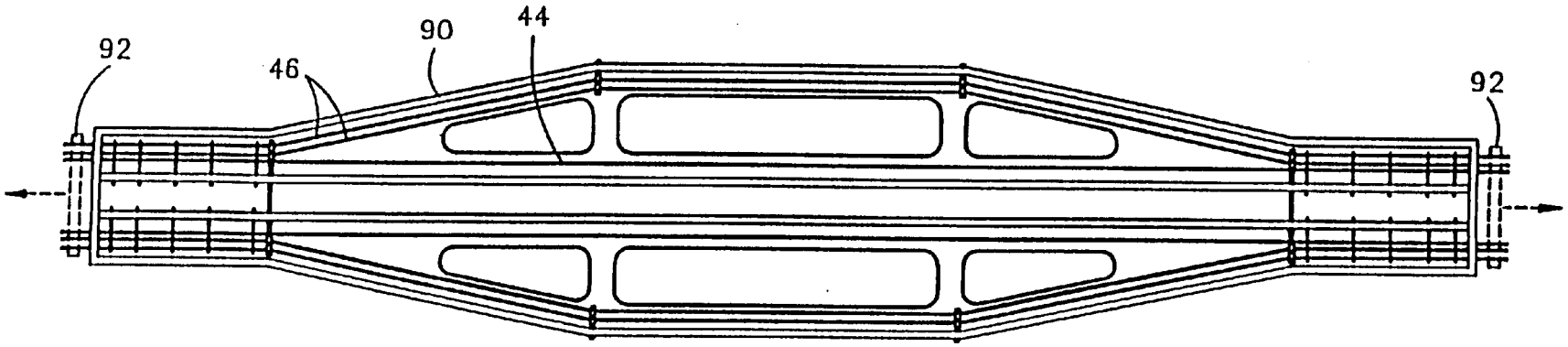
FIG. 23 is a plan view of the form shown in FIG. 22 illustrating the set up of prestress strands within the form.

FIG. 23 is a plan view of the form shown in FIG. 22 illustrating the set up of prestress strands (44 & 46) within the form. Preferably, the prestress strands (44 & 46) are attached to the frame 92 and a prestressing (tension) force is applied.

Figure 24:
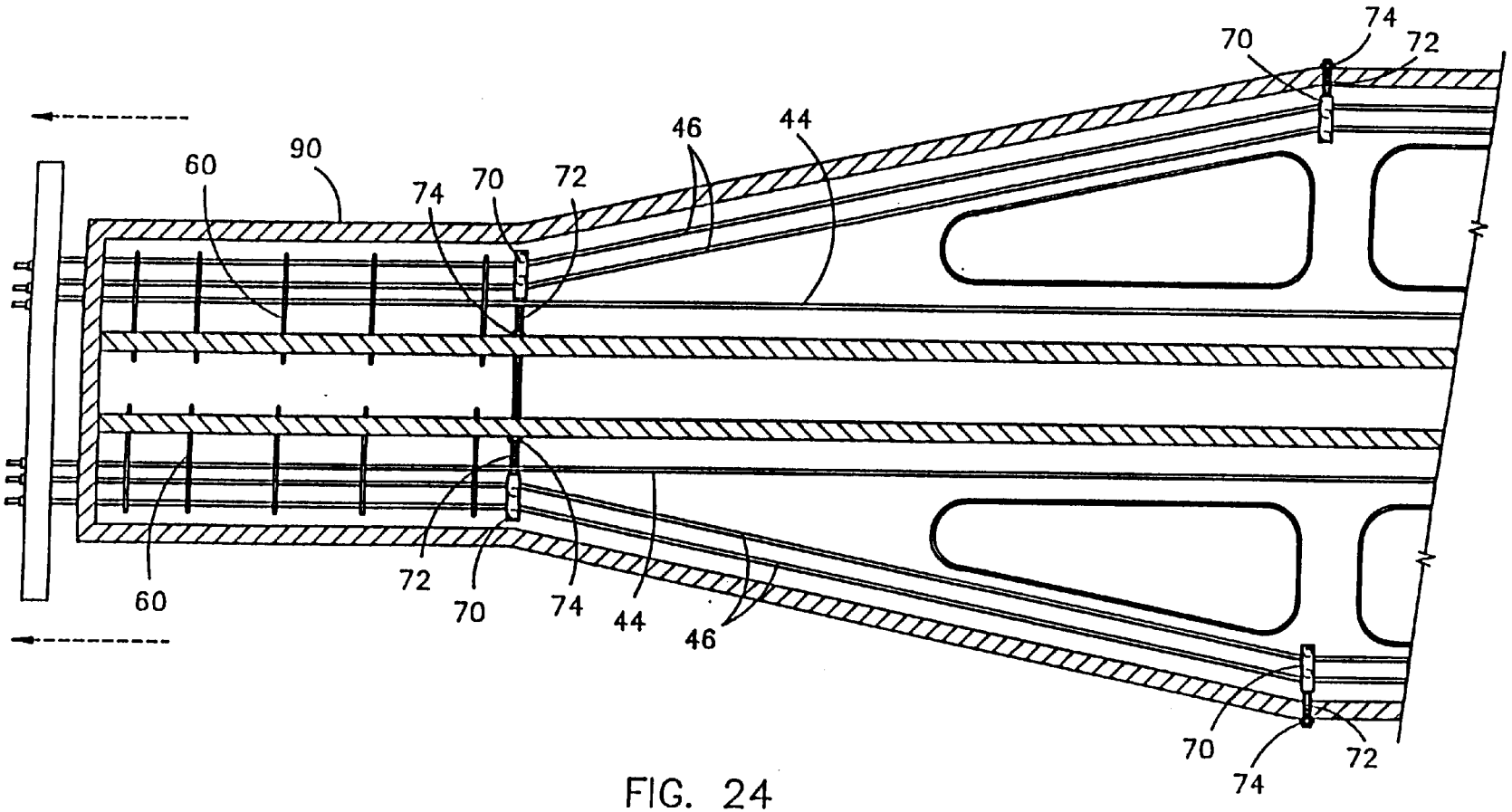
FIG. 24 is a partial plan view of the form shown in FIG. 22 further illustrating the placement of U-shaped ties into the joist.

FIG. 24 is a partial plan view of the form 90 shown in FIG. 22 further illustrating the placement of U-shaped ties 60 into the joist. FIG. 24 also illustrates prestress strand restraining devises 70 located at the point where the prismatic segment would transition into the bottom member and at a point where the top member and bottom member would be fully separated by the web. The prestress strand restraining devices 70 provide more favorable distribution of stresses within the joist by deflecting the prestress strands 46. Preferably, strands 44 extending through the top member need not be deflected. The prestress strand restraining devices 70 may be held in place during casting by threaded rods 72 which may be secured to the casting apparatus form 90 by a nut 74. After the concrete joist is poured and hardens, the threaded rod 72 may be cut off above the nut 74 or otherwise released from the casting apparatus.

Figure 26:
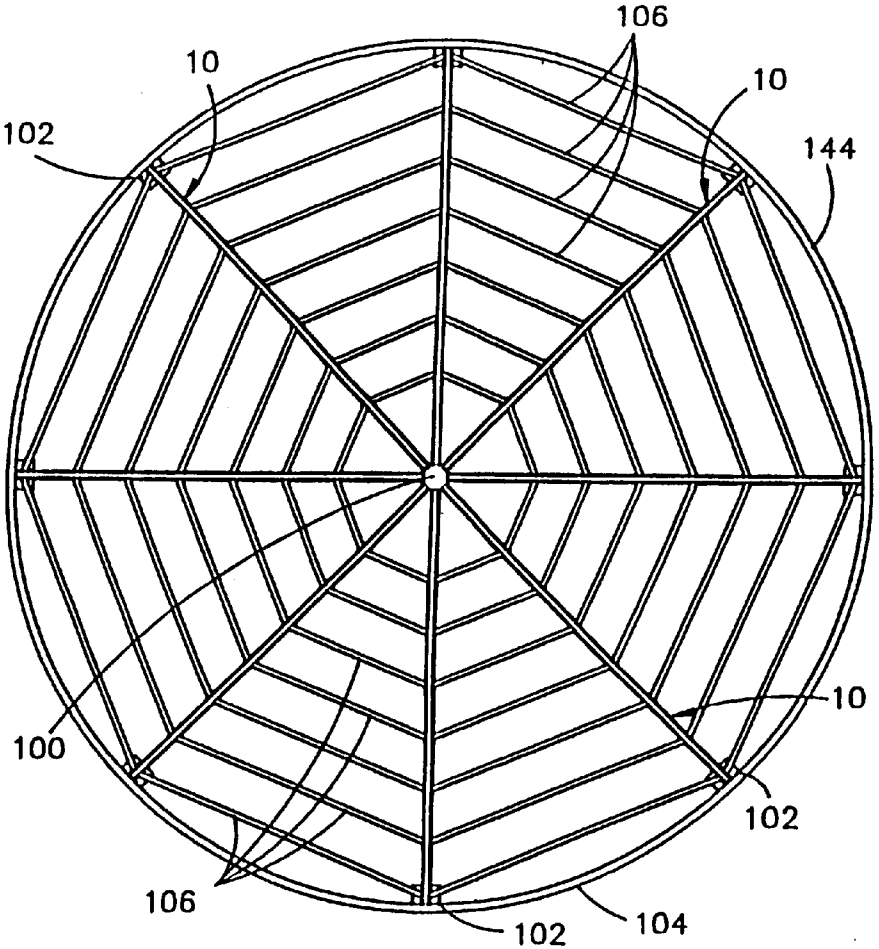
FIG. 26 is a plan view of an exemplary use of the present invention in the construction of a large building having curved or round exterior walls.
Figure 25:
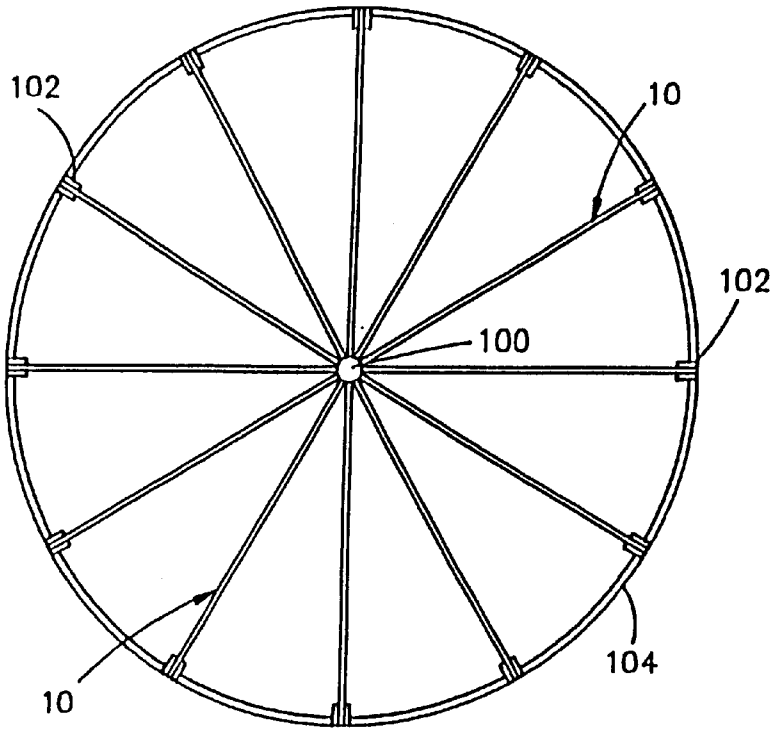
FIG. 25 is a plan view of an exemplary use of the present invention in the construction of a building having curved or round exterior walls.

FIGS. 25 and 26 are plan views of exemplary uses of the present invention in the construction of a building having curved or round exterior walls. In the embodiment shown in FIG. 25, precast, prestressed concrete joists 10 may extend radially from a central column 100 to peripheral columns 102. These peripheral columns 102 may be connected by curved beams 104 which may be of precast concrete, steel, or like construction. A concrete slab floor or the like may then be set on the joists 10. FIG. 26 illustrates a second scheme of the joists for construction of larger buildings having curved or round exterior walls. As in the first embodiment, precast, prestressed concrete joists 10 may extend radially from a central column 100 to peripheral columns 102. These peripheral columns 102 may be connected by curved beams 104 which may be of precast concrete, steel, or like construction. In this embodiment, however, additional joists 106 extend between the radial joists 10 to provide sufficient support for a floor slab, or roof while using a minimum of radial joists 10.

Figure 27:
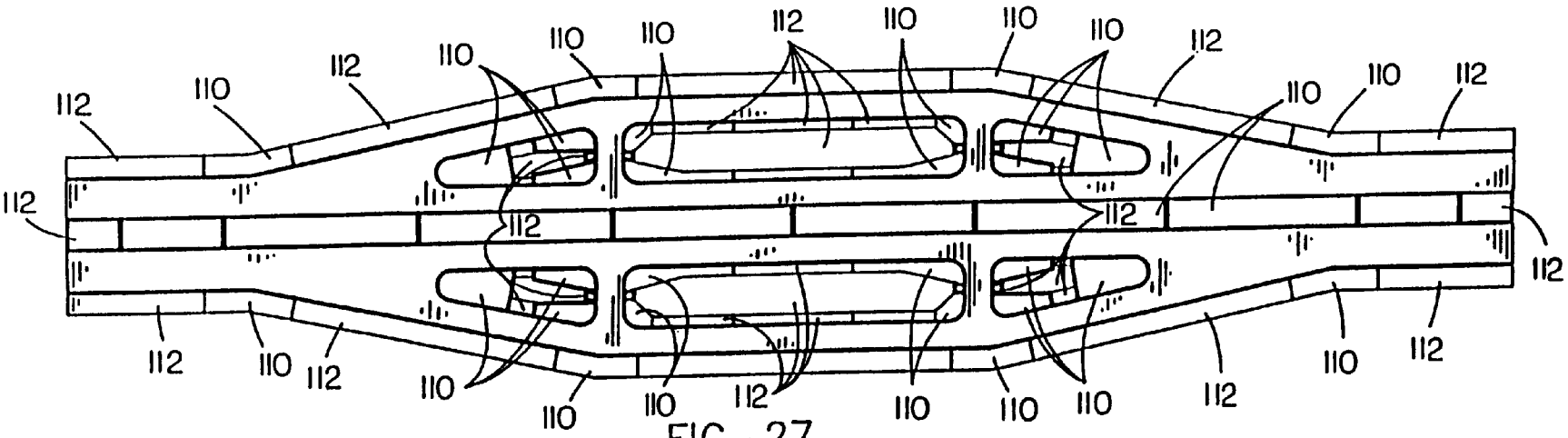
FIG. 27 is a plan view of the form shown in FIG. 22 illustrating the use of blocks of various shapes to create a form for casting the outer shape and web openings of a precast, prestressed concrete joist.

FIG. 27 is a plan view of the form shown in FIG. 22 illustrating the use of blocks of various shapes to create a form for casting the outer shape and web openings of precast, prestressed concrete joists. In an exemplary embodiment, permanent blocks 110 may be used to cast features of the joist that are constant for all spans and depths. Customizable blocks 112 may be added between these permanent blocks 110 to lengthen the joist or to increase its depth.

Figure 28:
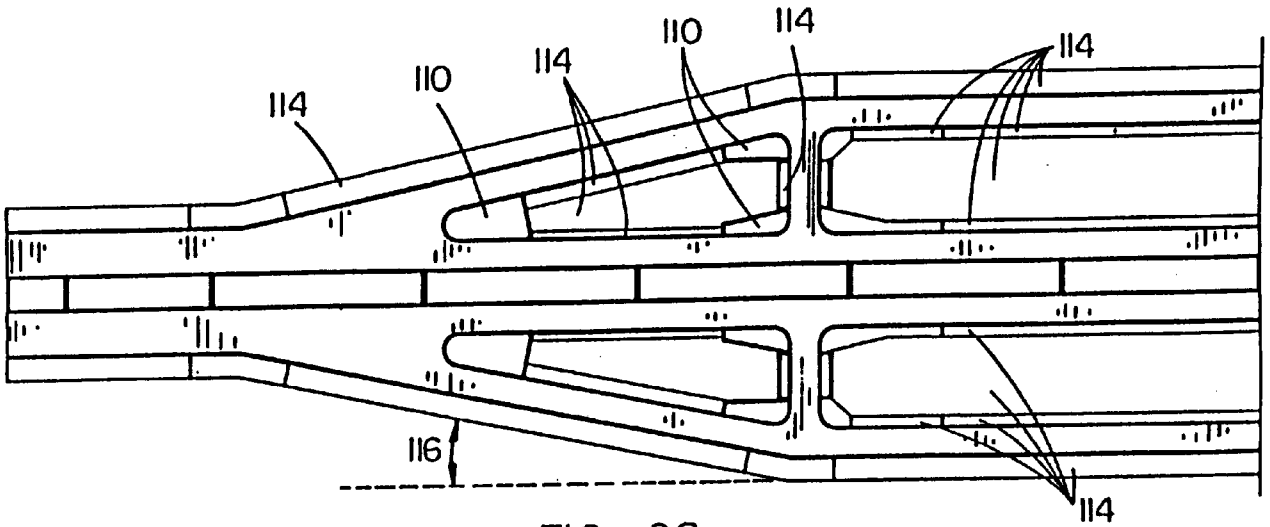
FIG. 28 is a partial plan view of the form shown in FIG. 22 illustrating in greater detail the usage of permanent and customizable blocks to form the outer shape of the joist and the web openings.

FIG. 28 is a partial plan view of the form shown in FIG. 22 illustrating in greater detail the usage of permanent and customizable blocks to form the outer shape of the joist and the web openings. Here, the permanent blocks 110, shown in FIG. 27, are again used to cast permanent features. For example, the inclined portion of the joist may have the same angle 116 for all joists. The variation in dimensions of the inclined portion of the joist may depend solely on the depth of the joist. For a certain joist depth, this inclined portion has fixed dimensions. Thus, to cast a joist having a greater span, longer customizable blocks 114 may be added.

FIGS. 22 through 24 and 27 through 28 illustrate layout of the joists during prestressing and casting. Prestress strand restraining devices may be necessary to maintain the prestress strand in the positions shown when tension is applied to the strands. Draping steel frames 87 (FIGS. 23 and 24) may be used to attach the prestress strand restraining devices in the proper positions. To fabricate a joist, the draping steel frames may be placed on a prestressing bed. Forms may then be constructed utilizing the permanent and customizable blocks described in connection with FIGS. 27 and 28. Prestress strand restraining devices may then be attached to the draping steel frames. Next, 7-wire prestress strands or the like may be inserted through the prestress strand restraining devices and anchored to the prestressing frame. A prestressing force may be applied to the strands. Conventional reinforcing ties or rebar may be installed in place. Fiber-reinforced plastic corrugate sheets may be attached to the straight side of the form for casting shear keys 89 into the joist. The straight side of the form will be the top of the joist when erected for its final position in the building's structure. Concrete may then be poured into the mold and allowed to cure. After hardening, the mold may be removed so that the completed joist may be transported to the building site.

Thus, it is apparent there has been provided, in accordance with the invention, a method and apparatus for manufacturing and utilizing an improved prestressed concrete joist which fully satisfies the objects, aims, and advantages set forth herein. While the invention has been described in conjunction with specific embodiments thereof, it is evident many alternatives, modifications, and variation will be apparent to those skilled in the art in light of the foregoing description, for example, the number, size, configuration, and placement of the strands may be altered or adjusted depending on load, span, and spacing. Accordingly, it is intended to embrace all such alternatives, modifications, and variations as fall within the spirit and broad scope of the appended claims.

What is claimed is:

1. A method for making a precast, prestressed concrete joist, comprising the steps of:

(a) forming generally horizontal top and bottom concrete members, the top member having a generally flat upper face and the bottom member having a generally flat bottom face, opposing left and right angled surfaces adjoining the top and bottom members wherein the top member forms two opposing prismatic ends and a concrete web interposed between the top and bottom members having at least one opening therein;

(b) extending at least one prestress strand lengthwise through the top member and prismatic ends;

(c) extending at least one prestress strand lengthwise between the prismatic ends through the left and right angled surfaces and the bottom member; and (d) applying prestressing force to the prestress strands.

2. The method of claim 1, wherein forming step (a) further comprises the steps of:

(a) assembling a form for molding the top and bottom concrete members, left and right angled surfaces and the concrete web;

(b) pouring concrete into the assembled mold;

(c) curing the concrete; and (d) removing the mold from the cured concrete.

3. The method of claim 2, wherein form assembling step (a) includes forming the opening in the web using at least one shaped block.

4. The method of claim 2, further comprising the step of lengthening the concrete joist by lengthening at least one of the form and the shaped block.

5. The method of claim 2, wherein at least one of extending step (b) and extending step (c) further comprises the steps of:

(a) assembling a frame;

(b) inserting a strand restraining device within the form and attaching the strand restraining device to the frame for deflecting the one or more prestress steel strands extending lengthwise through the top member and the prismatic ends and/or the one or more top steel strands extending lengthwise through the bottom members, left and right angled surfaces, and prismatic ends;

(c) anchoring an end of the prestress strand to the frame; and (c) passing the prestress strand through the strand restraining device.

6. The method of claim 5, wherein the strand restraining device is anchored to the frame via a threaded rod.

7. The method of claim 5, further comprising the step of detaching the strand restraining device from the frame after the concrete has cured wherein the strand restraining device remains within the concrete joist.

8. The method of claim 2, further comprising the step of inserting a plurality of U-shaped ties having a curved top section and two arms through the form so that the curved top section protrudes vertically from the upper face of the top member and/or from the upper face of the prismatic ends.

9. The method of claim 2, further comprising the step of forming a plurality of corrugated shear keys in the upper face of the top member.

10. The method of claim 2, further comprising the step of inserting reinforcement bars into the form so that the reinforcement bars extend vertically from the top member through the web to the bottom member.

11. A method for making a precast, prestressed concrete joist, comprising the steps of:

(a) assembling a form for casting generally horizontal top and bottom concrete members, the top member having a generally flat upper face and the bottom member having a generally flat bottom face, opposing left and right angled surfaces adjoining the top and bottom members wherein the top member forms two opposing prismatic ends and a concrete web interposed between the top and bottom members having at least one opening therein;

(b) extending at least one prestress strand lengthwise through the top member and prismatic ends;

(c) extending at least one prestress strand lengthwise between the prismatic ends through the left and right angled surfaces and the bottom member;

(d) applying prestressing force to the prestress strands;

(e) pouring concrete into the assembled mold;

(f) curing the concrete; and (g) removing the mold from the cured concrete.

12. The method of claim 11, wherein form assembling step (a) includes forming the opening in the web using at least one shaped block.

13. The method of claim 11, further comprising the step of lengthening the concrete joist by lengthening at least one of the form and the shaped block.

14. The method of claim 11, wherein at least one of extending step (b) and extending step (c) further comprises the steps of:

(a) assembling a frame;

(b) inserting a strand restraining device within the form and attaching the strand restraining device to the frame for deflecting the one or more prestress steel strands extending lengthwise through the top member and the prismatic ends and/or the one or more top steel strands extending lengthwise through the bottom members, left and right angled surfaces, and prismatic ends;

(c) anchoring an end of the prestress strand to the frame; and (d) passing the prestress strand through the strand restraining device.

15. The method of claim 14, wherein the strand restraining devices are anchored to the frame via threaded rods.

16. The method of claim 14, further comprising the step of detaching the strand restraining device from the frame after the concrete has cured wherein the strand restraining device remains within the concrete joist.

17. The method of claim 11, further comprising the step of inserting a plurality of U-shaped ties having a curved top section and two arms through the form so that the curved top section protrudes vertically from the upper face of the top member and/or from the upper face of the prismatic ends.

18. The method of claim 11, further comprising the step of forming a plurality of corrugated shear keys cast into the upper face of the top member.

19. The method of claim 11, further comprising the step of inserting reinforcement bars into the form so that the reinforcement bars extend vertically from the top member through the web to the bottom member.

* * * * *